United States Patent [19]

Gillis

[11] Patent Number: 4,944,322

[45] **Date of Patent: * Jul. 31, 1990**

[54] FOLDABLE TENT

[76] Inventor: Robert E. Gillis, P.O. Box 67, Aptos, Calif. 95001

[ * ] Notice: The portion of the term of this patent subsequent to Mar. 7, 2006 has been disclaimed.

[21] Appl. No.: 261,349

[22] Filed: Oct. 24, 1988

[51] Int. Cl.[5] ..... E04H 15/42

[52] U.S. Cl. ..... 135/105; 135/109; 135/119; 135/106

[58] Field of Search ..... 135/105, 106, 119, 115, 135/101, 100, 102, 109, DIG. 9

[56] References Cited

U.S. PATENT DOCUMENTS

| | | | |
|---|---|---|---|
| 2,842,145 | 7/1958 | Wilson, Jr. | 135/119 X |
| 3,181,542 | 5/1965 | Bareis | 135/105 X |
| 3,371,671 | 3/1968 | Kirkham | 135/105 X |
| 3,502,091 | 3/1970 | Corbin | 135/100 X |
| 3,766,932 | 10/1973 | Sidis et al. | 135/109 |
| 4,003,181 | 1/1977 | Robinson et al. | 135/105 |
| 4,078,572 | 3/1978 | Moss | 135/105 |
| 4,202,363 | 5/1980 | Watts et al. | 135/105 X |
| 4,665,935 | 5/1987 | Nichols | 135/119 X |
| 4,809,726 | 3/1989 | Gillis | 135/109 |

*Primary Examiner*—David A. Scherbel
*Assistant Examiner*—Caroline D. Dennison

[57] ABSTRACT

A foldable tent structure is provided wherein a plurality of pole clusters is utilized. Each pole cluster has three poles which form an inverted Y-shape, the poles being loosely connected at the center of the inverted Y so that each of the arms may articulate relative to each other. The poles forming the two arms of each inverted Y extend to the ground and the poles forming the stems of each Y extend upwardly and are connected to each other at the top of the structure. A foldable membrane is provided which is connected to both ends of each pole by a clip whereby a foldable tent structure is provided which may be assembled and disassembled repeatedly without separating the foldable membrane from the poles.

2 Claims, 2 Drawing Sheets

FOLDABLE TENT

SUMMARY OF THE INVENTION

This invention relates to tent structures in general and, more particularly, to a foldable tent structure which may be fully assembled by one person in approximately two minutes.

In accordance with the present invention, a framework of poles is provided wherein each of the poles is connected to a foldable membrane and each of the poles is free to articulate in such fashion that the entire structure may be assembled and disassembled repeatedly without separating the foldable membrane from the poles.

The prior art includes U.S. Pat. No. 3,502,091 to J. R. Corbin for a "Tent Supporting Frame," which does not teach a foldable tent structure which may be repeatedly assembled and disassembled with the membrane remaining connected to the supporting frame.

A primary object of the present invention is to provide a foldable tent structure which may be fully assembled in a relatively short period of time.

A further object of the invention is to provide a foldable tent structure in which a framework of poles is provided which supports a flexible membrane and wherein the poles are free to articulate with respect to each other to allow the structure to be repeatedly assembled and disassembled without separating the membrane from the poles.

Further objects and advantages of the invention will become apparent from the following description and the drawings wherein.

DETAILED DESCRIPTION OF THE DRAWINGS

Figure 1:
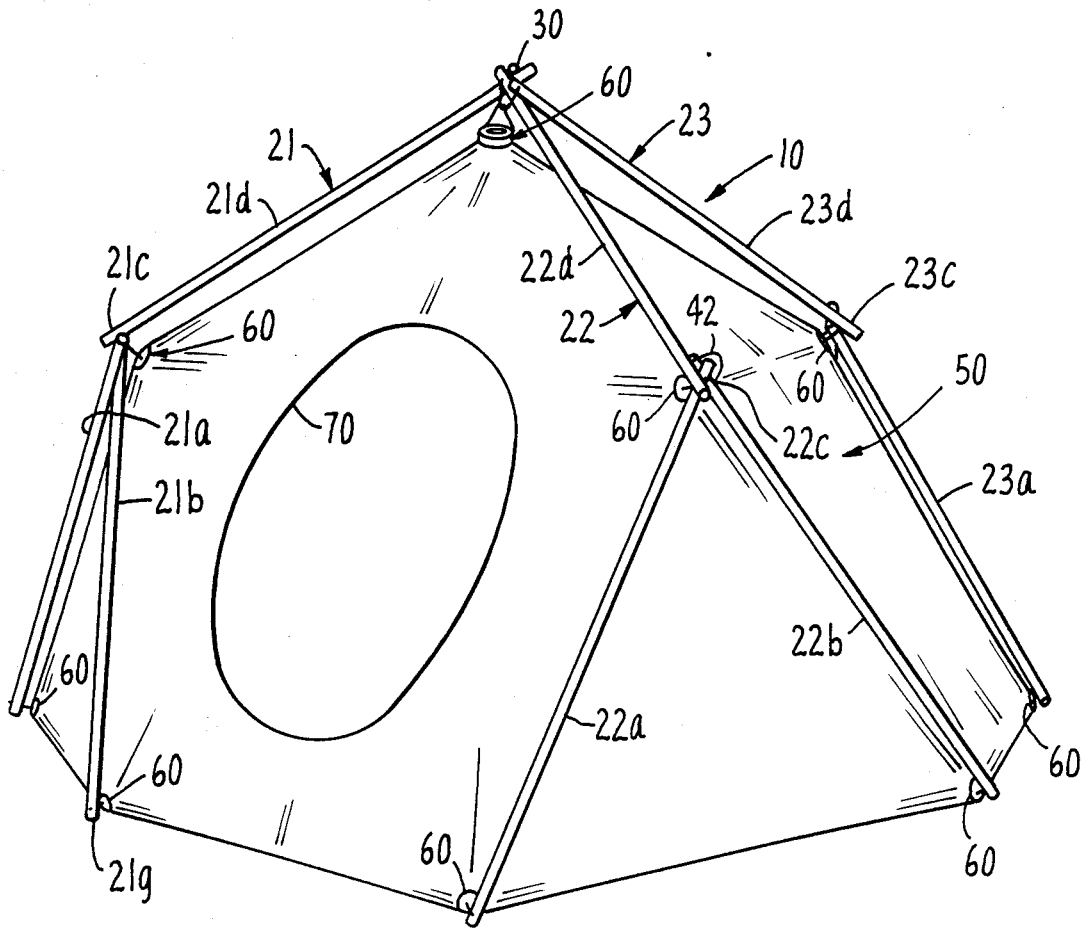
FIG. 1 is a perspective view of a foldable tent structure according to the present invention.

Referring to FIG. 1, a foldable tent structure referred to generally as 10 includes a plurality of pole clusters shown generally as 20 and a foldable membrane shown generally as 50.

In the embodiment shown in FIGS. 1–6, four pole clusters 21,22,23 and 24 are provided. Each pole cluster has three poles which form an inverted Y-shape. For example, pole cluster 22 includes poles 22*a* and 22*b* which form two arms of the inverted Y-shaped cluster, wherein said arms 22*a* and 22*b* extend from the center 22*c* of pole cluster 22 to the ground. Pole 22*d* of pole cluster 22 forms the stem of the inverted Y-shape cluster and extends upwardly to the top 30 of the tent structure 10.

Figure 3:
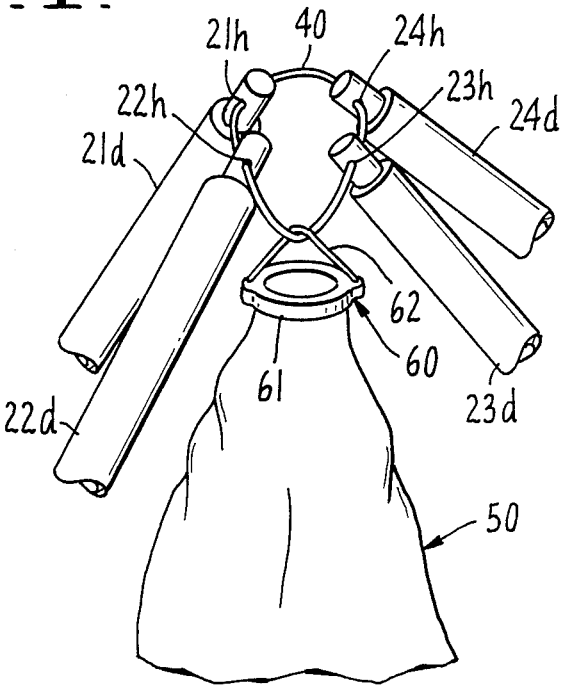
FIG. 3 is a schematic representation of a portion of the structure shown in FIG. 1.

Referring to FIG. 3, the top of the tent structure is shown schematically wherein the four stems 21*d*,22*d*,23*d* and 24*d* of each of the four pole clusters 21,22,23 and 24 are connected at the top of the structure by a cord 40 which extends loosely through holes 21*h*,22*h*,23*h* and 24*h* in the ends of each of said poles whereby each of said poles 21*d*–24*d* may articulate relative to each other to allow the tent structure to be folded and unfolded repeatedly. As shown in the embodiment in FIG. 3, foldable membrane 50 is connected to the upper ends of poles 21*d*–24*d* by clip means 60 which comprises a grommet 61 and a clip cord 62 In the embodiment shown, at each point where the foldable membrane 50 is connected to the plurality of poles 20, a clip means 60 is used such as shown in FIG. 3.

Each pole cluster 21–24 has three poles forming an inverted Y-shape , and at the center of each inverted Y, such as 22*c*, the three poles 22*a*,22*b* and 22*d* are joined together by connecting means 42 which comprises a cord similar to cord 40 shown in FIG. 3 which extends through holes formed in the upper ends of poles 22*a* and 20*b* and in the lower end of pole 22*d* such that cord 42 connects those three pole ends loosely together so that each of the poles in pole cluster 22 may articulate relative to each other to repeatedly fold and unfold the tent structure. Connecting means 42 is connected to clip means 60 in the fashion shown in FIG. 3.

As shown best in FIG. 1, each of the twelve poles used is connected at each of its ends to the membrane 50 by clip means 60.

Figure 2:
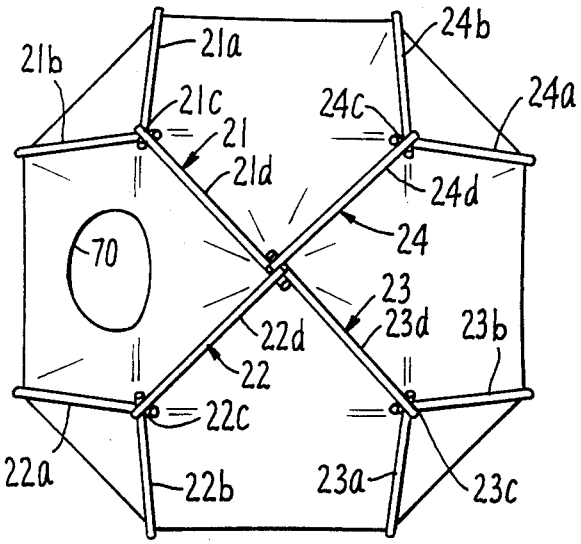
FIG. 2 is a plan view of the structure shown in FIG. 1.

A suitable entryway 70 may be provided between adjacent pole clusters 21 and 22 as shown in FIGS. 1 and 2. Although not shown in FIG. 1, the bottom end of the poles which extend to the ground may be staked to the ground for additional strength.

Figure 4:
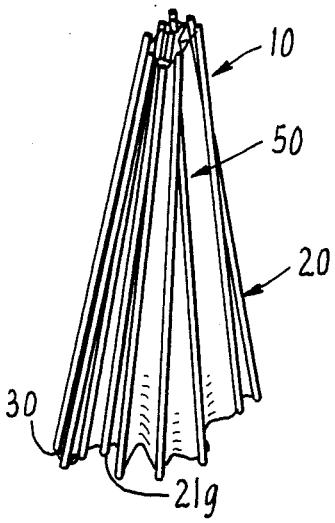
FIG. 4 is a perspective view of the tent structure according to the present invention shown in its folded position.
Figure 5:
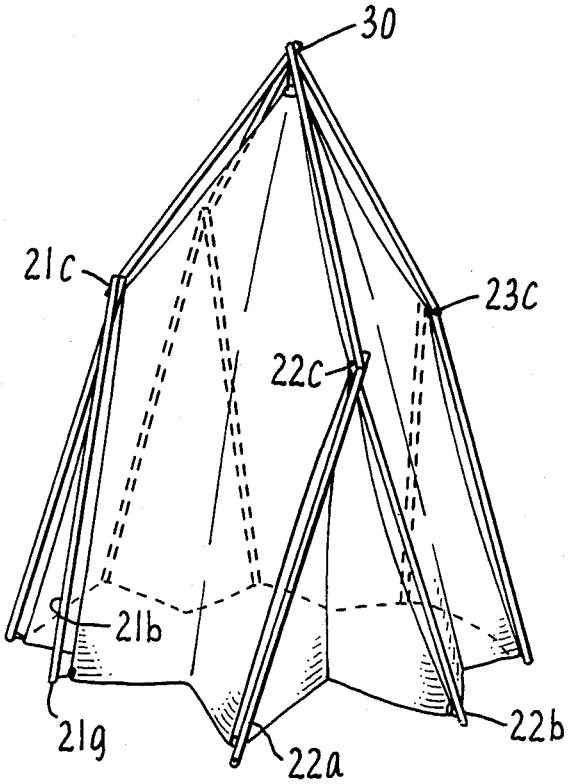
FIG. 5 is a perspective view of the tent structure partially unfolded.
Figure 6:
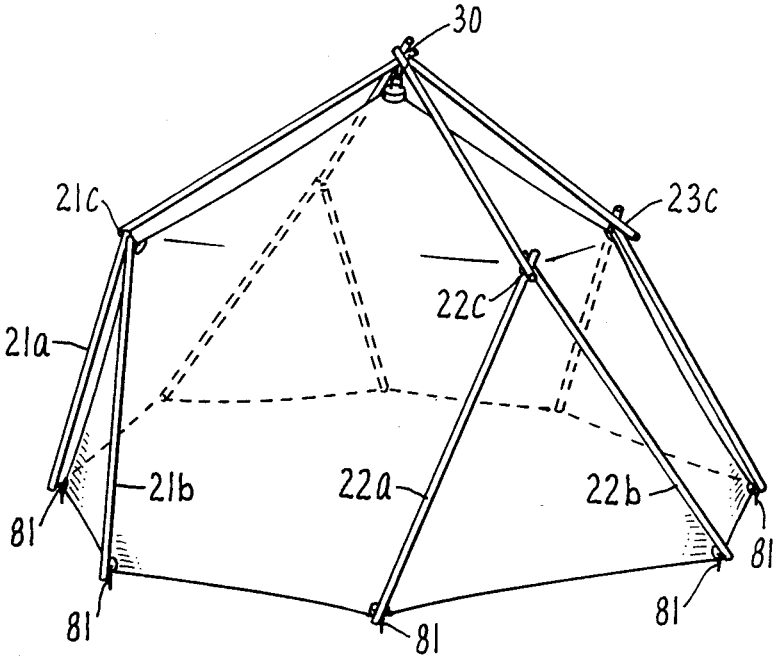
FIG. 6 is the tent structure shown in FIG. 5 in its fully unfolded or assembled position.

FIGS. 4, 5 and 6 show how easily the tent structure 10 may be unfolded and assembled. As shown in FIG. 4, the plurality of pole clusters 20 is shown in its folded position with membrane 50. In this folded position of FIG. 4, the top 30 of the pole structure is positioned adjacent the end 21*g* of pole 21*b*. To erect the tent, the lowermost portions of the poles are spread as shown generally in FIG. 5 and, if two persons are available, the top 30 of the tent is lifted simultaneously with spreading the bottom of the tent as shown in FIG. 5. If only one person is erecting the tent it is preferred that four of the lowermost poles such as 21*a*,21*b*,22*a* and 22*b* be stretched to their outermost positions as shown in FIG. 6, staked to the ground as shown by stakes 81 in FIG. 6, prior to the top 30 being lifted to its uppermost position. I have found that one person can fully erect this tent with stakes and lift top 30 to its uppermost position shown in FIG. 6 in approximately two minutes. The tent used has a top 30 which is approximately eight feet above the ground and a floor area of approximately 100 square feet.

As shown in FIGS. 4–6, the foldable membrane 50 remains connected to the plurality of poles 20 during the entire assembly of the tent. Similarly, the membrane remains connected during the entire disassembly. The tent structure shown in FIGS. 4–6 may be repeatedly assembled and disassembled without separating the membrane 50 from the pole structure 20.

I claim:

1. A foldable tent structure comprising:

a plurality of pole clusters each of said pole clusters having three poles which form an inverted Y-shape, said three poles being connected to each other by connecting means at the center of said inverted Y, the poles forming the two arms of each inverted Y-shape cluster extending to the ground and the poles forming the stems of each inverted Y-shape cluster extend upwardly and being connected to each other at the top of the structure the stem of each Y-shape cluster being adapted to articulate about the center of said inverted Y, so that in the folded position, the top of the tent is adjacent the lower ends of said arms, and a foldable membrane connected to both ends of each pole of each of said pole clusters by clip means, whereby said foldable tent structure may be assembled and disassembled repeatedly without separating said foldable membrane from said poles.

2. The apparatus of claim 1 wherein said connecting means comprises a cord extending loosely through holes in the ends of said poles, such that each of said poles in each said cluster may articulate relative to each other to repeatedly fold and unfold said tent structure.

* * * * *